US005426892A

United States Patent [19]

Haab et al.

[11] Patent Number: 5,426,892

[45] Date of Patent: Jun. 27, 1995

[54] SLIDING ELEMENT

[76] Inventors: Karl Haab, Obere Weidstrasse 7, CH-6343 Rotkreuz; Otto Haab, Im Erspach, CH-8932 Mettmenstetten, both of Switzerland

[21] Appl. No.: 115,496

[22] Filed: Sep. 1, 1993

[30] Foreign Application Priority Data

Oct. 9, 1992 [CH] Switzerland ..... 02851/92

[51] Int. Cl.[6] ..... E05D 15/22

[52] U.S. Cl. ..... 49/189; 49/176; 160/180

[58] Field of Search ..... 49/163, 188, 189, 176, 49/177; 160/116, 180

[56] References Cited

U.S. PATENT DOCUMENTS

| | | | |
|---|---|---|---|
| 815,011 | 3/1906 | Hanson . | |
| 1,169,283 | 1/1916 | Peterick . | |
| 1,500,288 | 7/1924 | Weber | 49/189 X |
| 1,649,665 | 11/1927 | Christenson | 49/189 |
| 1,842,629 | 1/1932 | Dickel et al. | 49/189 |
| 1,862,397 | 6/1932 | Hamelin | 49/189 |
| 1,888,213 | 11/1932 | Baker | 49/188 |
| 2,851,695 | 9/1958 | Dietrich | 160/180 X |
| 2,933,756 | 4/1960 | Muessel . | |
| 2,955,314 | 10/1960 | Tylman . | |
| 3,090,424 | 5/1963 | Carlo | 160/116 X |
| 3,114,942 | 12/1963 | Abedon et al. . | |
| 3,143,760 | 8/1964 | Ferguson . | |
| 3,145,414 | 8/1964 | Martin . | |
| 3,694,851 | 10/1972 | Matuska . | |
| 3,786,534 | 1/1974 | Ferguson . | |
| 4,222,201 | 9/1980 | Yanessa | 49/189 |
| 4,467,562 | 8/1984 | Hemmerling . | |
| 4,760,872 | 8/1988 | Hale | 160/180 X |
| 5,031,274 | 7/1991 | Eutebach . | |

FOREIGN PATENT DOCUMENTS

| | | | |
|---|---|---|---|
| 0340795 | 5/1993 | European Pat. Off. . | |
| 2447442 | 8/1980 | France . | |
| 1270988 | 6/1968 | Germany . | |
| 3425765 | 1/1986 | Germany . | |
| 3610892 | 10/1987 | Germany . | |
| 3807207 | 9/1989 | Germany | 49/176 |
| 9207157 | 4/1992 | WIPO . | |

*Primary Examiner*—Jerry Redman

*Attorney, Agent, or Firm*—Egli International; Christa Hildebrand

[57] ABSTRACT

A sliding element slidable on trolleys along a rail comprises a swing door swivellably suspended on a top frame strip and having, in a bottom frame strip (6') an anchoring device having a hinge stud (16) which can be lowered to engage with a receiving bush rotatably anchored in the floor. The hinge stud (16) is formed on a wedge-shaped hinge part (17) of metal which is guided for vertical sliding on a guide section (18) in the bottom frame strip (6') and engages slidably along a slide section (19) with a matching section (22) of a likewise wedge-shaped lowering part (23) of plastics material. Said lowering part is provided, in a recess (24), with a driving nut (25) which engages through a self-locking thread connection with a lowering bolt (27) which is positively connected by way of a bevel gear unit (29) to an operating pin (30) suitable for engagement of a hexagon socket key. A torque-limiting claw clutch may be inserted between the bevel gear unit (29) and the lowering bolt (27). The hinge part (17) can be moved up and down by turning the operating pin (30) but in every position is unable to be displaced even by high forces exerted by the receiving bush on the hinge stud (16).

17 Claims, 4 Drawing Sheets

SLIDING ELEMENT

BACKGROUND OF THE INVENTION

1. Field of the Invention

The invention relates to a sliding element. Sliding elements of this kind are mainly used in glass fronts, for example of shops, which generally consist of a plurality of plain sliding sheets and in which a glass sheet is fastened in each case on a top one-piece frame strip, which is usually suspended on two trolleys movable along a rail, a,bottom frame strip being attached to the bottom end of said glass sheet, and of at least one sliding element in which the glass sheet and optionally the bottom part of the top frame strip may if desired be pivotable relative to the part suspended on the trolleys and form a swing door.

Fronts of this kind can be completely pushed aside in hot weather. No obstructing projecting parts should then remain on the floor, in which there should be only grooves or other depressions for guiding or fixing the sliding sheets and the sliding element. In cooler weather, on the other hand, the front is closed and entry is possible only through the swing door. The latter must then be reliably anchored so that it can withstand the considerable forces and moments exerted on it, particularly when it is opened.

2. Description of the Related Art

Sliding elements are known which have a frame which completely surrounds the swing door and is not moved when the door swivels, so that it can be anchored fast but detachably in the floor. The bottom part of a frame of this kind, however, necessarily forms a sill which makes passage through the swing door difficult, particularly for example with shopping trolleys, and is therefore undesirable.

SUMMARY OF THE INVENTION

The problem underlying the invention is accordingly that of indicating a sliding element in which the swing door itself can be anchored in the floor rotatably but at the same time sufficiently firmly, and detachably in the floor, while a frame surrounding the door, particularly a bottom frame strip extending under the swing door, is not required.

This problem is solved by the present invention.

The advantages achieved through the invention consist above all in that the swing door is rotatably fastened directly in the floor by means of an anchoring device and can therefore extend to the floor and an obstructing sill does not exist. The bottom frame strip is an integral component part of the swing door. Access, even with shopping trolleys or wheeled shopping baskets or with wheelchairs, is thus possible without problems.

The invention allows embodiments which are immediately adaptable to changes in the structure of the building, such as subsidence of the floor or ceiling and will continue to function faultlessly and which in addition require only a narrow bottom frame strip, so that the swing door can consist almost entirely of glass. In particular, side frame members can be dispensed with, so that the front can be in the form of a glass front not interrupted by vertical strips which would be undesirable for aesthetic reasons.

BRIEF DESCRIPTION OF THE DRAWINGS

The invention is described more fully below with the aid of drawings which merely illustrate an example of embodiment, and in which.

DESCRIPTION OF THE PREFERRED EMBODIMENT

Figure 1:
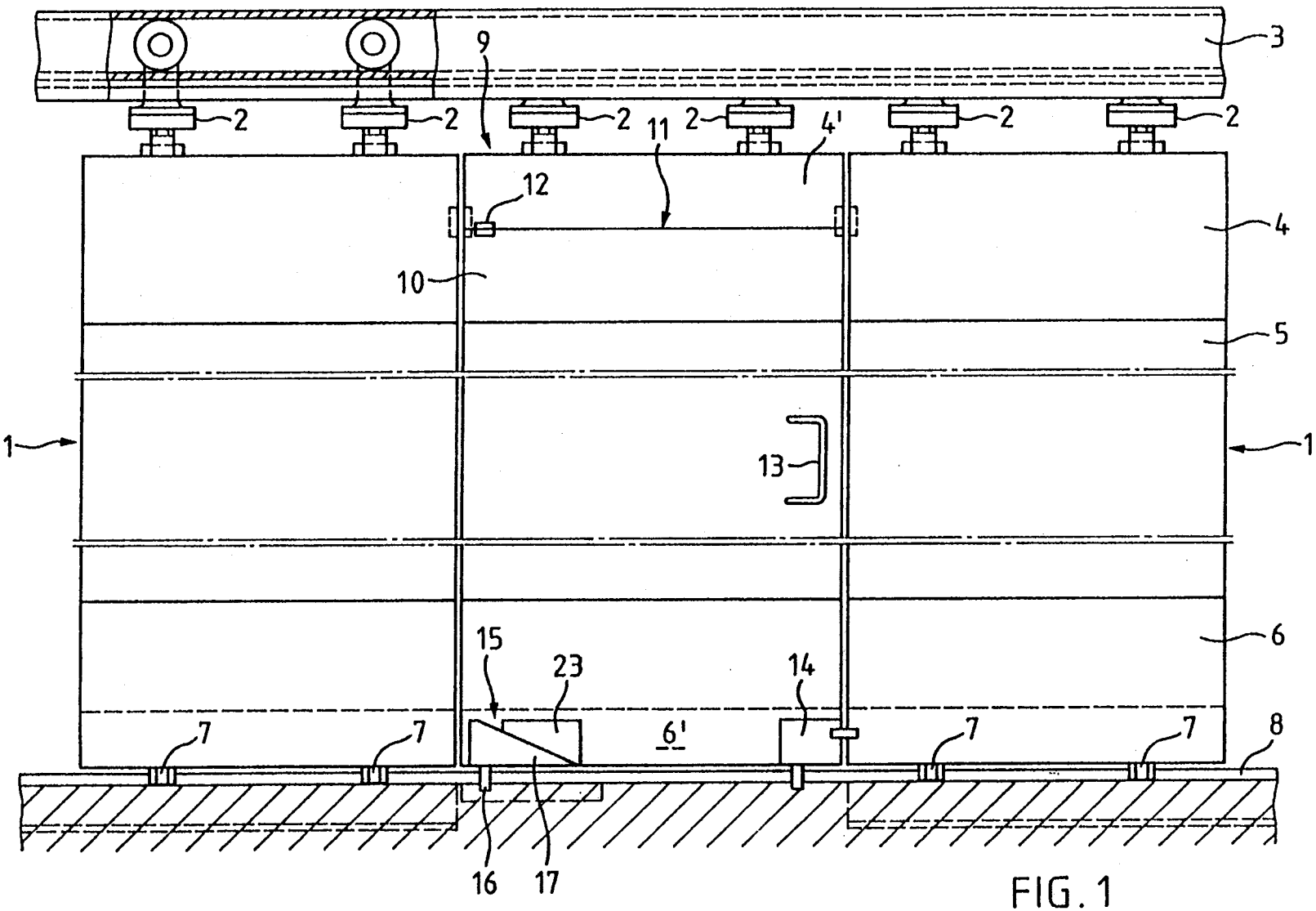
FIG. 1 shows schematically a part of a shop front containing a sliding element according to the invention, with a swing door.
Figure 2:
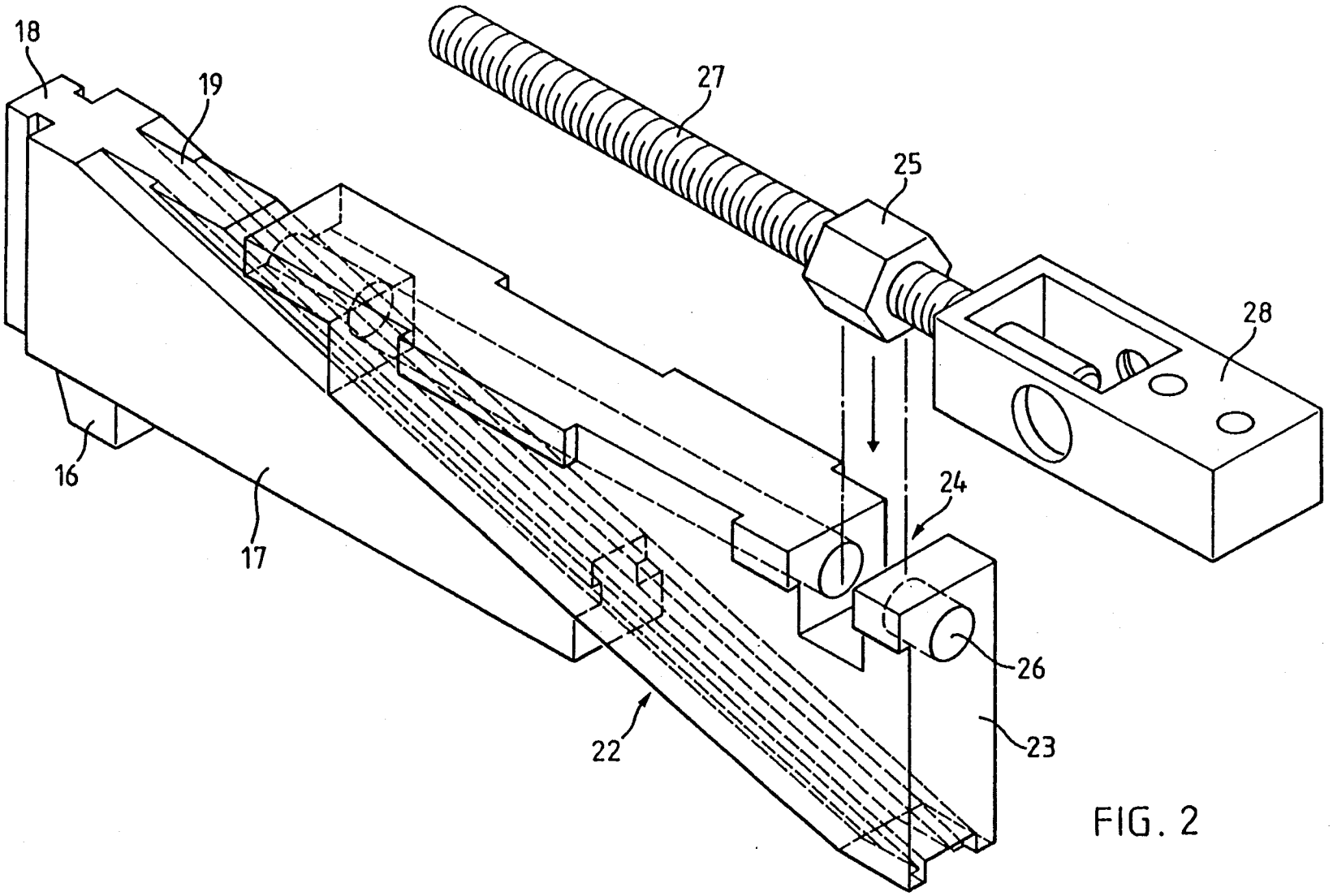
FIG. 2 shows in a partly exploded view in perspective the anchoring device for the swing door.

FIG. 1 shows a part of a glass front comprising two plain sliding sheets 1, each of which consists of a top frame strip 4 which is suspended on a rail 3 by means of two trolleys 2 and on which is fastened a glass sheet 5 forming the major part of the area of the sliding sheet 1. At the bottom end of the glass sheet 5 is fastened a bottom frame strip 6 to which sliding members 7 engaging in a guide groove 8 in the floor are attached. The frame strips are each in the form of aluminium sections engaging around the glass sheet 5.

Between the sliding sheets 1 is disposed a sliding element 9 according to the invention, on whose top frame strip 4', which is narrower than that of the neighboring sliding sheets 1, a swing strip 10 of a swing door 11 is rotatably fastened by means of a hinge 12 disposed in the left-hand edge region. As in the case of the sliding sheets 1, a glass sheet 5, to which at the bottom a bottom frame strip 6' is attached, is suspended on the swing strip 10.

The top frame strip 4' of the sliding element 9 and the swing strip 10 complement one another in such a manner that together, when the swing door 11 is closed, they correspond exactly on the outside to the top frame strip 4 of a sliding sheet 1, while on the outside the bottom frame strip 6' of the swing door 11 corresponds exactly to that of a sliding sheet 1. With the swing door 11 closed, therefore, the uninterrupted appearance of a continuous front is obtained, and this may be accentuated by grooves in the top frame strips 4 of the sliding sheets 1 at the height of the dividing line between the top frame strip 4' of the sliding member 9 and the swing strip 10.

At halfway height the swing door 11 is provided on the inside and outside with handles 13 fastened on the glass sheet 5. A lock 14 is let into the bottom frame strip 6' of said door and can be operated by means of a key, said lock having two bolts, of which one can engage with one of the neighboring sliding sheets 1 and the other can engage with a bushing sunken into the guide groove 8 in the floor.

At the opposite end an anchoring mechanism 15 is built into the bottom frame strip 6' of the swing door 11 and is provided with a hinge stud 16 which can engage in a receiving bush (not shown) rotatably anchored in the floor and then in conjunction with the hinge 12 forms a swinging axis about which the swing door 11 can swivel. The hinge stud 16 engages positively in the receiving bush, which offers a determined resistance to the swivelling of the swing door 11 and automatically closes it except at certain locking angles at which the swing door 11 remains open. Floor anchoring systems of this kind are known for fixed swing doors and require only adaptation. The hinge stud 16 can be raised so that it is no longer in engagement with the receiving bush and so that, when the swing door 11 is unlocked, the sliding element 9 and also the sliding sheets 1 can be pushed aside.

The construction and mode of operation of the anchoring device 15 are explained below with reference to FIGS. 2, 3, 4*a*, 4*b*, 5*a*, 5*b*.

The hinge stud 16 is made in one piece with a mechanically very strong hinge part 17 of metal, preferably steel. The hinge part 17 is solid and wedge-shaped, with a bottom horizontal surface, a vertical surface carrying a guide section 18 in the form of a T-section, and an inclined surface which over its entire length is provided with a slide section 19 likewise in the form of a T-section. The guide section 18 engages with a vertical guide groove 20 in a guide part 21 mounted in a fixed position in the bottom frame strip 6'.

The hinge stud 16, which has a square cross-section and tapers slightly in the downward direction is disposed on the horizontal surface of the hinge part 17, directly adjoining the guide section 18 of said hinge part, while the slide section 19 begins above the hinge stud 16 and extends downwards away from the guide section 18 with a sliding angle $\alpha$ of 17° to the horizontal. This construction makes it possible to dispose the hinge stud 16 near the side edge of the bottom frame strip 6'.

The slide section 19 engages from below in a T-groove in a matching section 22, which likewise extends over the entire inclined surface of a lowering part 23 which is likewise wedge-shaped and has a horizontal top face and which is solid and, except for a driving nut 25 inserted non-translatably and non-rotatably in a recess 24, is made in one piece of plastics material, for example high-molecular polyethylene with micro glass balls and additives. The lowering part 23 can slide easily, relative to the hinge part 17, along the slide section 19, while the engagement between the slide section 19 and the matching section 22 allows only very slight play transversely to the direction of the sections.

Beneath the horizontal surface the lowering part 23 has a longitudinal bore 26, which is interrupted by the recess 24 and into which projects a lowering bolt 27 provided with a trapezoidal thread and engaging with the driving nut 25, which is a hexagonal nut lying with one side face on the bottom of the recess 24 and having a corresponding internal thread. This connection between the lowering bolt 27 and the driving nut 25 is self-locking. The lowering bolt 27 is mounted non-translatably but rotatably in a wall of a drive casing 28, wherein by means of a bevel gear unit 29 it is operatively connected to an operating pin 30 which is provided with a socket for the engagement of a hexagon socket key and is directed at right angles to the plane of the swing door 11 and which projects into an opening in the bottom frame strip 6', so that it can be operated from outside.

Figure 3:
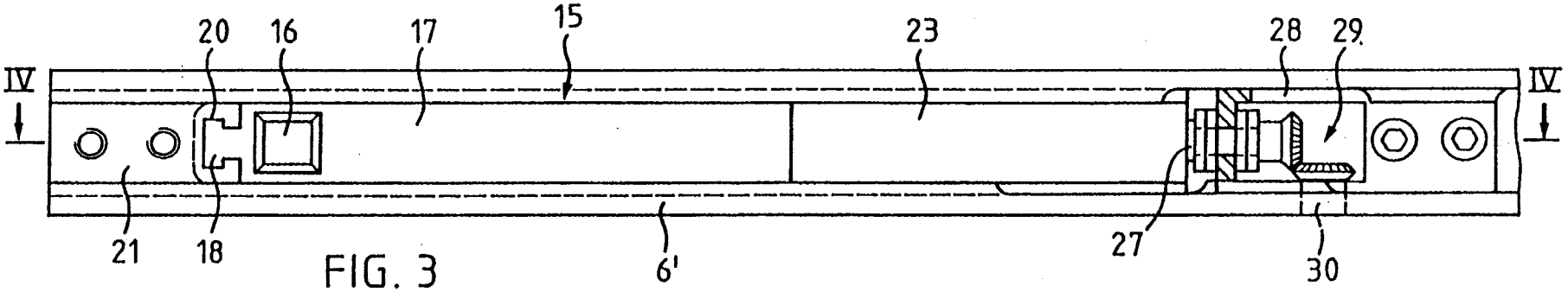
FIG. 3 is a view from below of the anchoring device in the position of non-engagement.
Figure 4A:
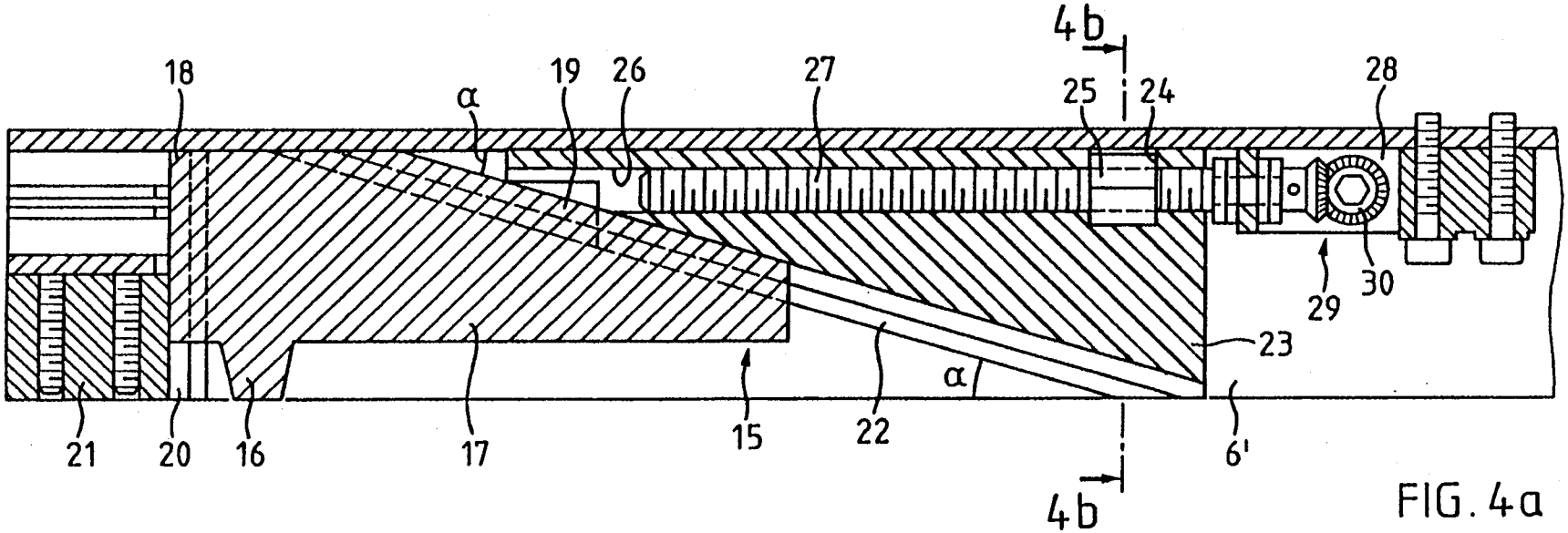
FIG. 4*a* is a section on the line IV—IV in FIG. 3.

In the condition of non-engagement visible in FIG. 3, and particularly in FIG. 4*a*, the hinge part 17 is situated at the top end of the lowering range. The hinge stud 16 is completely retracted into the bottom frame strip 6'. Provided that the lock 14 has been unlocked, the sliding element 9 can be slid unhindered along the rail 2, for example from a stacking position to the intended position in the glass front.

Figure 5A:
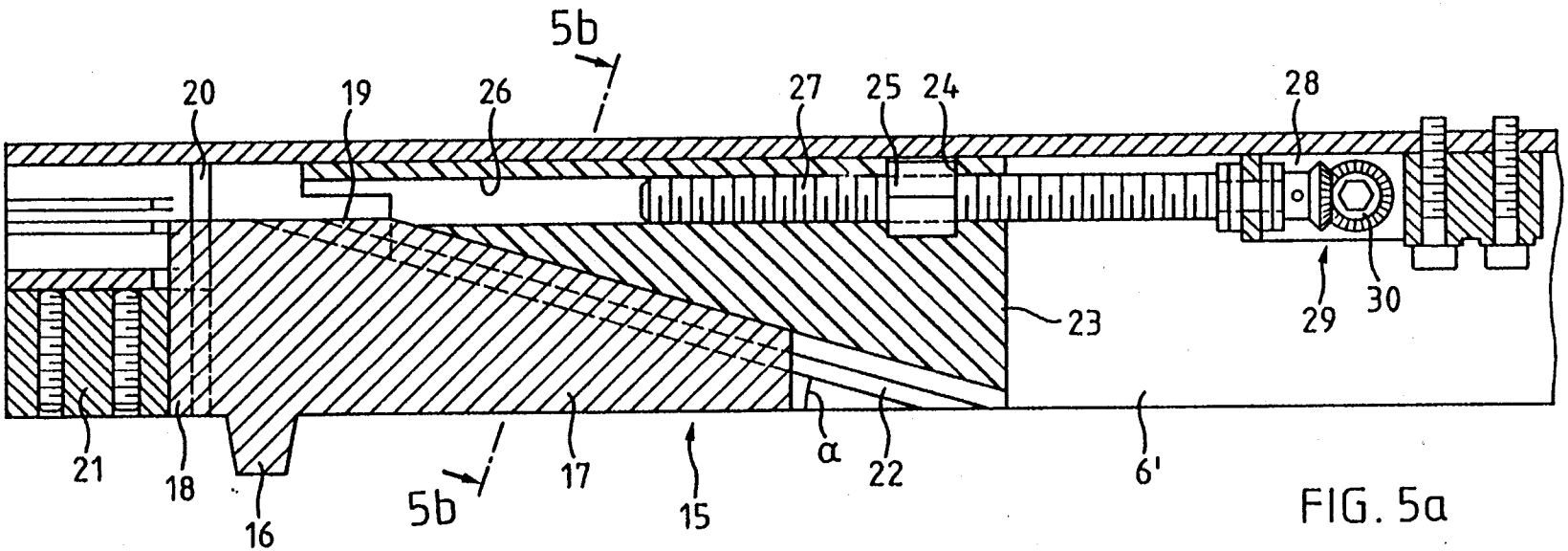
FIG. 5*a* is a section through the anchoring device corresponding to FIG. 4*a*, but in the position of engagement.
Figure 4B:
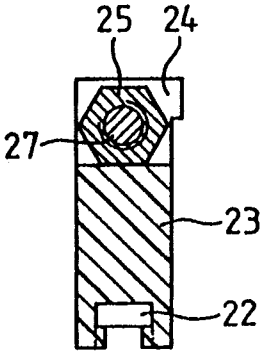
FIG. 4*b* is a section on the line B—B in FIG. 4*a;*
Figure 5B:
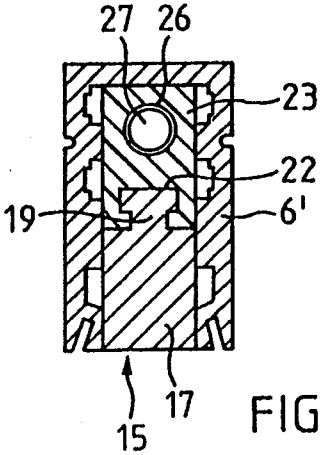
FIG. 5*b* is a section on the line B—B in FIG. 5*a*.

In that position a hexagon socket key can then be engaged in the socket in the end of the operating pin 30 and the latter turned. The turning is transmitted through the bevel gear unit 29 to the lowering bolt 27, so that the driving nut 25 in engagement with it moves to the left and carries with it the lowering part 23, which in turn moves the hinge part 17, with which it is in engagement by means of the slide section 19 of the latter, along the guide groove 20 downwards into a position of engagement (see FIG. 5*a*), in which the hinge stud 16 engages with the receiving bush. The lowering range over which the hinge part 17 can be lowered may be relatively large. In FIG. 5*a*, a mean position is shown.

The forces necessary for adequate anchoring of the hinge stud 16 in the receiving bush are relatively great because of the high forces and moments acting on the swing door 11; typically they amount to about 50 kp. Because of the double transmission ratio through the screw thread engagement between the lowering bolt 27 and the driving nut 25, and the wedge formed by the lowering part 23 and having a relatively small sliding angle $\alpha$, a relatively low torque exerted on the operating pin 30 is sufficient to apply this force. Conversely, high forces acting on the hinge stud 16 are also stepped down to such an extent that they can without difficulty be taken by the self-locking action of the engagement referred to and any additional internal friction, and cannot give rise to upward displacement of the hinge part 17. The latter is therefore automatically locked in every position, so that the effectiveness of the anchoring device 15 does not depend on the vertical position of the receiving bush as long as the latter is situated within the lowering range. Subsidence of the floor and other changes to the structure of the building can thus be compensated for without difficulty and do not impair the functioning of the anchoring device.

In order to make it impossible for excessive forces to be exerted on the hinge stud 16 as the result of misoperation, which could result in the lifting of the door and damage to the trolley 2 and other parts, the lowering bolt 27 may for example be connected to the bevel gear unit 29 by way of a claw clutch, in such a manner that the torque transmitted during lowering is limited, preferably to a value such that the force acting on the hinge stud 16 is just not sufficient to effect the lifting of the swing door 11. The torque effecting the lifting of the hinge part 17 may also be limited by the clutch, preferably to a somewhat lower value, so that the anchoring device 15, if turned too far in this direction, cannot wedge fast and that the hinge part 17 can at any time be lowered again by turning in the opposite direction.

Since the hinge part 17 engages from below with the lowering part 23 lying above it, the slide section 19 and the matching section 22, when in the position of engagement in which large forces have to be transmitted, are in contact over a relatively long path, over which the forces are distributed. High local loads are thus avoided.

The lifting of the hinge part 17 into the position of non-engagement is effected analogously to the lowering into the position of engagement.

The anchoring device described is very compact and can be accommodated in a narrow bottom frame strip, even in the case of a relatively large lowering range.

What is claimed:

1. A sliding element comprising a frame having a top frame strip suspended on at least one trolley movable along a rail, and a swing door fastened on the frame by means of a hinge, and the swing door having a bottom end, wherein the bottom end is provided with an anchoring device and a hinge stud wherein the hinge stud is vertically movable over a lowering range in order to be brought into releasable engagement with a floor extending below the bottom end of the door so as to form, together with the hinge, a swinging axis about which the swing door is swivellable.

2. The sliding element according to claim 1, having a hinge part guided for vertical movement in the swing door and carrying on its lower face the hinge stud, and with a lowering part horizontally movable in the swing door, and wherein one of said parts carries a slide section which encloses with the horizontal an acute sliding angle ($\alpha$) and with which the other part engages positively in such a manner that mutual displacement of the hinge part and the lowering part in the direction of the slide section is possible, while at right angles thereto limited play at most exists.

3. The sliding element according to claim 2, wherein at the slide section the hinge part engages from below with the lowering part.

4. The sliding element according to claim 2, wherein the part carrying the slide section has an at least approximately wedge-shaped configuration with a horizontal surface, a vertical surface and an inclined surface which carries the slide section.

5. The sliding element according to claim 2, wherein the hinge part carries the slide section and the hinge stud is disposed at the hinge part remote from the lowering part.

6. The sliding element according to claim 5, wherein the lowering part has a matching section which engages positively with the slide section.

7. The sliding element according to claim 6, wherein the slide section or the matching section is made of metal and the matching section and the slide section is made of plastics material.

8. The sliding element according to claim 7, wherein the plastics material is high-molecular polyethylene with micro glass balls.

9. The sliding elements according to claim 5, wherein the lowering part has an at least approximately wedge-shaped configuration with a horizontal surface, a vertical surface and an inclined surface having a matching section.

10. The sliding element according to claim 2, wherein the slide section is in the form of a T-section.

11. The sliding element according to claim 2, wherein the sliding angle ($\alpha$) amounts to between 12° and 22°.

12. The sliding element according to claim 2, wherein the hinge part, including the hinge stud, is made in one piece of metal.

13. The sliding element according to claim 2, wherein the lowering part is substantially made of a one piece plastic material.

14. The sliding element according to claim 2, wherein the lowering part is provided with a screw thread in which a lowering bolt engages which is mounted horizontally in the swing door such as to be rotatable and non-translatable.

15. The sliding element according to claim 14, wherein the screw thread engagement between the lowering part and the lowering bolt has a self-locking action.

16. The sliding element according to claim 14, wherein in a recess in the lowering part a driving nut is inserted in such as to be non-translatable and non-rotatable and carries the screw thread with which the lowering bolt engages.

17. The sliding element according to claim 14, wherein the lowering bolt is connected via a bevel gear unit to an operating pin rotatably mounted transversely to the plane of the swing door and having an end suitable for the engagement of an operating tool.

* * * * *